US005668441A

United States Patent [19]

Genz

[11] Patent Number: 5,668,441

[45] Date of Patent: Sep. 16, 1997

[54] METAL HALIDE HIGH-PRESSURE DISCHARGE LAMP

[75] Inventor: Andreas Genz, Berlin, Germany

[73] Assignee: Patent-Treuhand-Gesellschaft für Elektrische Glühlampen mbH

[21] Appl. No.: 557,045

[22] PCT Filed: Jun. 20, 1994

[86] PCT No.: PCT/DE94/00702

§ 371 Date: Dec. 5, 1995

§ 102(e) Date: Dec. 5, 1995

[87] PCT Pub. No.: WO95/01648

PCT Pub. Date: Jan. 12, 1995

[30] Foreign Application Priority Data

Jul. 2, 1993 [DE] Germany ..... 43 22 115.7

[51] Int. Cl.[6] ..... H01J 61/12; H01J 61/82

[52] U.S. Cl. ..... 313/637; 313/113; 313/571; 313/641; 313/642; 313/639

[58] Field of Search ..... 313/113, 570, 313/571, 637, 638, 639, 640, 641, 642

[56] References Cited

U.S. PATENT DOCUMENTS

| | | | |
|---|---|---|---|
| 3,761,758 | 9/1973 | Bamberg et al. | 313/640 |
| 4,686,419 | 8/1987 | Block . | |
| 5,363,007 | 11/1994 | Fromm et al. | 313/639 X |

*Primary Examiner*—Nimeshkumar Patel

*Attorney, Agent, or Firm*—Frishauf, Holtz, Goodman, Langer & Chick, P.C.

[57] ABSTRACT

A high-pressure metal halide lamp which is particularly suitable for inclusion in optical systems is run at specific power between 100 and 180 W per mm arc length. The lamp includes, per $cm^3$ chamber volume, between 0.3 and 3 μmol dysprosium, hafnium and lithium respectively and between 0.2 and 2 μmol indium, whereby luminance of between 25 and 75 $kcd/cm^2$ can be generated at color temperature of between 4500 and 7000 K. Light spots with a diameter of about 4 mm and a color reproduction index Ra of 80 are achieved by means of a special reflector. This makes it possible to use the lamp in combination with thin glass-fiber bunches for illumination purpose, e.g. in endoscopy.

8 Claims, 2 Drawing Sheets

METAL HALIDE HIGH-PRESSURE DISCHARGE LAMP

FIELD OF THE INVENTION

The invention relates to a metal halide high-pressure discharge lamp having a mean arc power of between 100 and 180 W/mm of arc length.

BACKGROUND

Metal halide high-pressure discharge lamps of this type are used particularly for fiber-optic illuminating systems in medicine (endoscopy) and technology (boroscopy), where light at color temperatures between 4500 and 7000 K. and good to very good color rendition in all color temperature ranges, along with high lighting intensities, are needed.

Low-loss coupling of the light into the fiber-optic bunch necessitates good focusing, or in other words a focusing diameter that is less than or at most equal to the usable diameter of the fiber-optic bunch. To produce a corresponding light spot, the arc core is essentially projected by a reflector or other optical system. If the light emitted by the arc core does not include all the spectral components of the total light emitted by the lamp, then the color rendition property of the focused light can worsen compared with that of the unfocused light. It is therefore highly important, with a view to use in the aforementioned focusing systems, to purposefully find fill ingredients that emit at the hot arc core and not only at the cooler arc edge. Moreover, for good focusing and high light intensities at the entry to the fiber-optic bunch, especially compact lamp dimensions and a very short light arc (only a few millimeters) with maximum light densities (on average, several tens of kcd/cm$^2$) must be sought.

From European Patent Disclosure EP 0 193 086, to which U.S. Pat. No. 9,686,419, Blook et al. corresponds, assigned to the assignee of this application, metal halide high-pressure discharge lamps with similar short light arcs and correspondingly high light densities are known that produce light with good color rendition properties.

However, their disadvantage is that the fills of these lamps contain cadmium. For the sake of environmental protection, at the end of the lamp life the toxic heavy metal, cadmium, must be returned to the raw material cycle or be properly disposed of, which in both cases involves attendant costs. Moreover, the lamps with a Cd filling have an irritating greenish tinge, and the color location is located above Planckian locus.

It is an object of The Invention to create a metal halide high-pressure discharge lamp that has a very short light arc with a very high light density as well as a color temperature between 4500 and 7000 K. at a color location near the Planckian locus, good color rendition, and especially in combination with a strongly focusing reflector or other optical system, and that attains this object with a cadmium-free fill.

Briefly, the fill of the lamp according to the invention comprises mercury, at least one noble gas and at least one halogen, and metals that form halides, namely dysprosium (Dy), hafnium (Hf), lithium (Li) and indium (In). The fill quantities, in micromoles per milliliter (μmol/ml) of vessel volume, are advantageously between 0.3 and 3 each for Dy, Hf and Li, and between 0.2 and 2 for In.

The metal halide high-pressure discharge lamp is operated at specific arc powers between 100 and 180 W per millimeter of arc length. Given the compact geometrical dimensions of the lamp—very short electrode spacing (a few millimeters) and small vessel volume (a few tenths of a millimeter)—this is equivalent to wall loads of 70 to 120 W/cm$^2$ of wall area of the discharge vessel. By means of the fill components, according to the invention, of the discharge vessel, mean light densities of 25 to 75 kcd per cm$^2$ of arc area are attained, which can be focused with the aid of a reflector or other optical system onto a light spot whose diameter is less than 10 mm. The particular value of the invention is that the good to very good color rendition (Ra≧75) is preserved even after focusing, and the color location is near Planckian locus, and this is achieved with a fill that does without the toxic cadmium used until now.

Dysprosium, with its multiple-line spectrum, assures a high radiation flux in the visible range of the electromagnetic spectrum and additionally contributes to the continuous spectrum. Hafnium also produces a multiple-line spectrum and moreover reduces the tendency to devitrification, by building up a reinforced halogen jacket on the bulb wall. Because of the high vapor pressure of hafnium halides, the tendency to bulb blackening is also reduced, and consequently the usable light flux during the lamp life is increased.

By means of lithium and indium, the radiation flux especially in the red and blue portions of the optical spectral region is reinforced. Overall, the light emitted has a spectral composition that is quite close to that of Planckian radiation, or in other words has good to very good color rendition properties. Depending on the proportion of fill quantities of the various components, light can be generated with a color temperature between 4500 and 7000 K.

The lamp according to the invention is preferably used in dichroitic special reflectors, which essentially project the inner arc core. By the purposeful selection of the two atomic radiators, lithium and indium, which radiate preferentially in the hot arc core, it is achieved that the good color rendition properties are preserved even at the focal point of this reflector. Moreover, by the use of lithium in combination with hafnium, high color stability is attained; that is, the color temperature varies only slightly over the lifetime of the lamp.

For arc stabilization, the discharge vessel can contain in addition up to 3 μmol of cesium per cm$^3$ of vessel volume. To maintain the halogen cycle process, iodine and bromine are preferably used in a molar ratio between 0.3 and 1.5. The lamp also contains mercury, in an amount of typically a few tens to a few hundreds of μmol per cm$^3$ of vessel volume and a noble gas, such as argon, as the basic gas. The fill pressure of the noble gas in the cold lamp is less than atmospheric pressure—typically a few tens of kPa—so that in this case risk-free manipulation is possible. On the other hand, the pressure range is high enough that upon ignition an undesired evaporation of the tungsten electrodes with an attendant blackening of the discharge vessel is largely prevented.

The metal halide high-pressure discharge lamp according to the invention, while preferably used in a reflector securely joined to the lamp, can nevertheless also be used without an integrated joined reflector.

DRAWINGS

The invention will be described in further detail in terms of the ensuing exemplary embodiment. Shown are:

FIG. 1, a fragmentary sectional side view of a metal halide high-pressure discharge lamp according to the invention with a reflector;

FIG. 2, one spectrum each from the arc core (A) and lower arc edge (B) of the lamp of FIG. 1.

DETAILED DESCRIPTION

Figure 1:
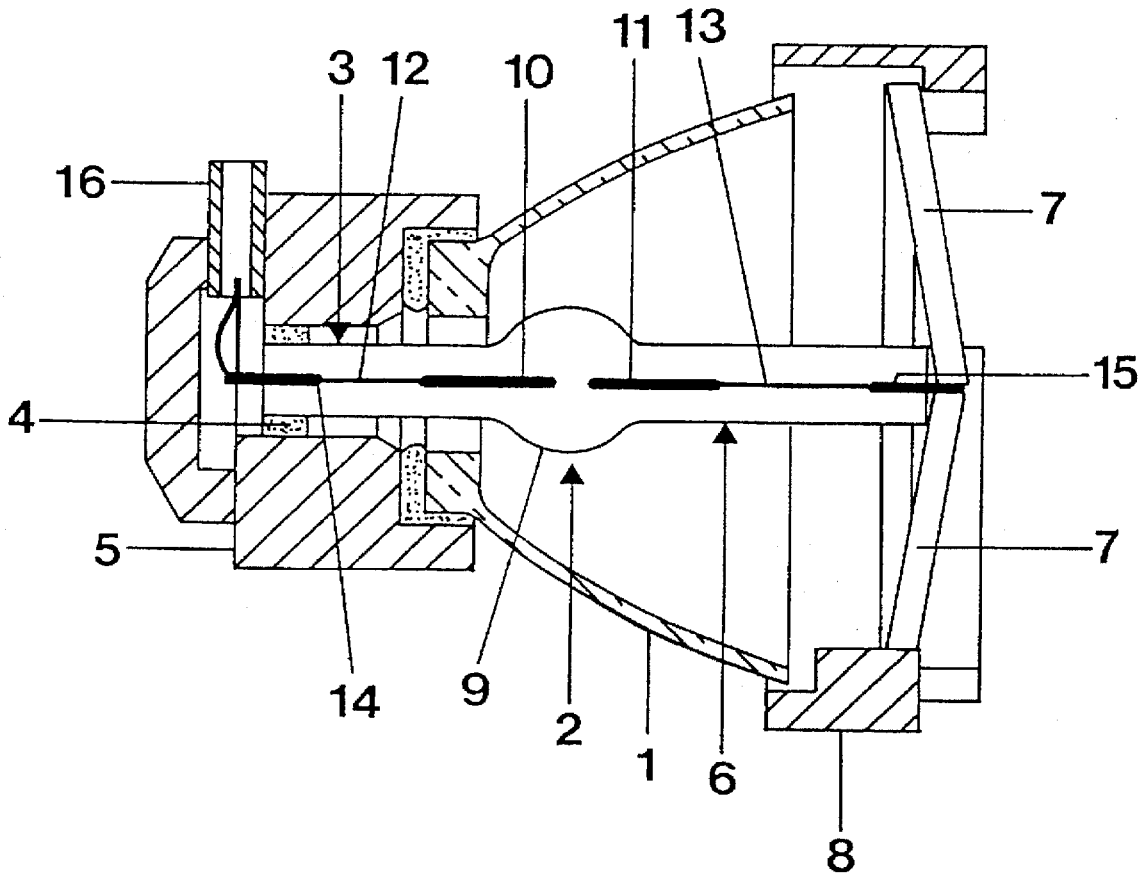

FIG. 1 shows a metal halide high-pressure discharge lamp 2, built into a reflector hose combination assembly 1, with a power consumption of 270 W. The lamp 2 has its axis located in the axis of the reflector 1. While an electrode shaft 3 is secured by means of cement 4 to the ceramic base 5, the other electrode shaft 6 is retained on the ceramic closure ring 8 of the reflector 1 by copper bands 7 that at the same time act as power supply leads. The metal halide high-pressure discharge lamp 2 has a discharge vessel 9, whose volume is 0.35 $cm^3$. The electrodes 10, 11 are joined, at a spacing of 2.2 mm, via vacuum-tight-sealed molybdenum foils 12, 13 to the power supply leads 14, 15. One power connection 16 is mounted in the base 5, and the other (not visible here) is mounted on the closure ring 8 of the reflector 1.

The reflector 1 produces a substantially circular light spot in the focal plane with a light power $\phi$ of virtually Gaussian spatial distribution of lighting intensity E(r). In polar coordinates, it is therefore approximately true that $$E(r) = \frac{2\Phi}{\pi r_0^2} \cdot e^{-2r^2/r_0^2}$$

where r is the radial coordinate and $r_0$ is the radius of the light spot. The radius $r=r_0$ accordingly indicates the radial spacing from the center of the light spot at which the lighting intensity is less, by the factor $1/e^2$, than the maximum lighting intensity $E_{max}(r=0)=2\Phi/\pi r_0^2$ in the center of the light spot. The thus-defined diameter $d=2.r_0$ of the light spot is approximately 4 mm—within this dimension, $1-1/e^2=$ 86.5% of the total light power of the light spot (in reliance on the tentative standard DIN V 18730) is located. The opening angle of the caustic surface of the beam in the region of the focus is approximately 60°. Thus virtually the entire light flux can be efficiently coupled into thin fiber-optic bunches, and the useful diameter of the fiber-optic bunch can be as small as 4 mm, as long as the acceptance angle of the bunch is at least 60%. From the following table, a fill according to the invention of the discharge vessel 9 of the lamp 2 of FIG. 1 and the technical lighting data of this lamp that are attained (color rendition index Ra for lamp 2 including reflector 1) can be seen.

TABLE

| Quantity of fill ingredients in μmol: | |
|---|---|
| Dy: | 0.5 |
| Hf: | 0.45 |
| Li: | 0.35 |
| In: | 0.22 |
| Cs: | 0.32 |
| J: | 2.8 |
| Br: | 3.9 |
| Hg: | 42.5 |
| Fill pressure of the basic gas (Ar): | 45 kPa |
| Discharge vessel volume: | 0.35 $cm^3$ |
| Electrode spacing: | 2.2 mm |
| Power consumption: | 270 W |
| Arc drop voltage: | 40 V |
| Specific arc power: | 125 W/mm |
| Wall load: | 82 $W/cm^2$ |
| Light yield: | 70 lm/W |
| Mean light density: | 35 $kcd/cm^2$ |
| Ra (lamp including reflector): | 80 |

TABLE-continued

| Quantity of fill ingredients in μmol: | |
|---|---|
| Color temperature | 5400 K. |
| Lifetime: | >250 h |

Figure 2:
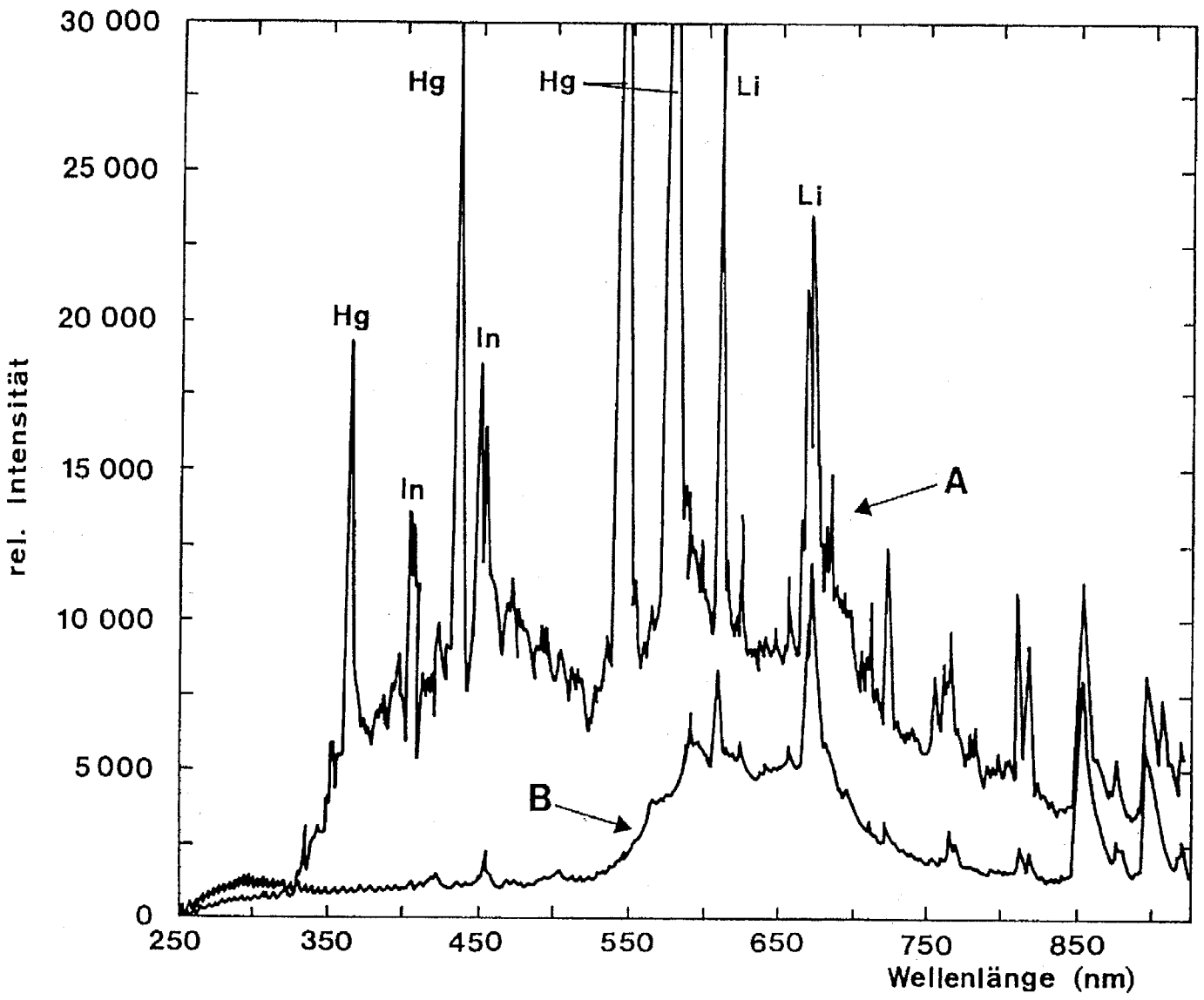

The balanced spectral composition of the light emitted from the arc core—which is the prerequisite for good color rendition when a focusing reflector is used—is documented in FIG. 2. This shows two emission spectra, measured with the aid of a spectrometer, of the lamp described in FIG. 1 in the spectral range between 250 and 925 nm.

They originate from the light from the arc core A and from the lower arc edge B, respectively, and clearly illustrate the location dependency of the spectral composition of the emitted light. The relative light intensity is plotted in relative units on the ordinate, and the wavelength is plotted in nanometers (nm) on the abscissa. The spectral resolution of the spectrometer used is approximately 1.5 nm. Its spectral transmission function was corrected with the aid of the spectrum of a halogen incandescent bulbs for wavelengths >350 nm. The strongest lines of the mercury are not shown completely, so that the structure of the remaining spectra can be more clearly seen (the maximum values of the aforementioned lines are approximately 67,000 in relative units). The two most striking characteristics of both spectra are the background and the great number of spectral lines that show up against it. The background comprises continuum radiation (recombinant radiation of unbound electrons), molecule bands (such as halide molecules), and closely spaced resonance lines of atomic radiators (such as Dy, Hf), which are not resolved into individual lines by the spectrometer used.

Because of the fill ingredients according to the invention, the light emitted from the arc core and then focused by the reflector has, as desired, a balanced spectral composition, which is similar to a Planckian distribution, within the entire visible range (approximately 380 to 780 nm). As can be clearly seen, filling out of the spectrum A in the green-blue and the red range is attained in particular by indium and lithium, so that finally good to very good color rendition of the light emitted from the arc core is attained. The light emitted from the arc edge, conversely, does not have any good color rendition properties, since the blue-green spectral component is markedly underrepresented (see spectrum B).

I claim:

1. A metal halide high-pressure discharge lamp (2) having a mean arc power between 100 and 180 W per millimeter of arc length, in particular for incorporation into optical systems (1), having a discharge vessel (9) of high-temperature-proof light-transmissive material, two high-temperature-resistant electrodes (10, 11) and a filling of mercury, at least one noble gas, at least one halogen, and other metals that form metal halides, characterized in that to produce light with a color temperature between 4500 and 7000 K. and light densities between 25 and 75 $kcd/cm^2$, the fill contains dysprosium, hafnium, lithium and indium as halide-forming metals.

2. The lamp of claim 1, characterized in that the fill quantity of the dysprosium, hafnium and lithium is between 0.3 and 3 $\mu mol/cm^3$ of vessel volume each.

3. The lamp of claim 1, characterized in that the fill quantity of the indium is between 0.2 and 2 $\mu mol/cm^3$ of the vessel volume.

4. The lamp of claim 1, characterized in that the discharge vessel additionally contains up to 3 μmol of cesium per $cm^3$ of the vessel volume.

5. The lamp of claim 1, characterized in that the discharge vessel contains iodine and bromine as halogens for the halide compounds.

6. The lamp of claim 5, characterized in that the molar ratio of iodine and bromine is between 0.3 and 1.5.

7. The lamp of claim 1, characterized in that the lamp forms a structural unit with a focusing optical reflector, which in its focal plane produces a light spot having a diameter between 3 mm and 10 mm, and a color rendition index of the light of Ra≧75 is attained.

8. The lamp of claim 1, in combination with a reflector (1), wherein the lamp is positioned in the reflector to produce a substantially circular light spot in the focal plane thereof.

* * * * *